US009637849B2

(12) United States Patent
Schröder et al.

(10) Patent No.: US 9,637,849 B2
(45) Date of Patent: May 2, 2017

(54) DEVICE AND METHOD FOR THE TREATMENT, IN PARTICULAR ELECTROLYSIS OR CLEANING, OF ENDLESS FIBERS, THREADS OR WEBS OF FABRIC

(71) Applicant: OERLIKON TEXTILE GMBH & CO. KG, Remscheid (DE)

(72) Inventors: Rolf Schröder, Langen (DE); Erwin Glawion, Grobostheim (DE)

(73) Assignee: OERLIKON TEXTILE GMBH & CO. KG, Remscheid (DE)

( * ) Notice: Subject to any disclaimer, the term of this patent is extended or adjusted under 35 U.S.C. 154(b) by 0 days.

(21) Appl. No.: 14/432,723

(22) PCT Filed: Jun. 27, 2013

(86) PCT No.: PCT/EP2013/001893

§ 371 (c)(1),
(2) Date: Mar. 31, 2015

(87) PCT Pub. No.: WO2014/053201

PCT Pub. Date: Apr. 10, 2014

(65) Prior Publication Data

US 2015/0275411 A1 Oct. 1, 2015

(30) Foreign Application Priority Data

Oct. 6, 2012 (DE) ..... 10 2012 019 637

(51) Int. Cl.
*D06B 3/02* (2006.01)
*D06B 3/04* (2006.01)
(Continued)

(52) U.S. Cl.
CPC ..... *D06B 19/007* (2013.01); *D06B 3/02* (2013.01); *D06B 3/04* (2013.01); *D06B 3/10* (2013.01); *D06B 3/12* (2013.01); *D06C 7/04* (2013.01)

(58) Field of Classification Search
CPC . D06B 3/02; D06B 3/04; D06B 3/045; D06B 3/10; D06B 19/007
See application file for complete search history.

(56) References Cited

U.S. PATENT DOCUMENTS 1,387,072 A 8/1921 Putnam
2,364,838 A * 12/1944 Williams ..... D06B 3/20 68/1
(Continued)

FOREIGN PATENT DOCUMENTS

AU 2071070 A * 4/1972 ..... D06B 19/007
BE 491067 A 9/1949
(Continued)

*Primary Examiner* — Steven A. Friday
(74) *Attorney, Agent, or Firm* — FisherBroyles, LLP; Robert Kinberg

(57) ABSTRACT

The invention relates to a bath and to a method of treating endless fibers, filaments or fabric webs, especially for electrolysis or for cleaning, comprising a bath container (4), which is at least partly filled with a processing fluid, and means for introducing the endless fibers, filaments or fabric webs, characterized in that the means are arranged in such a way that the endless fibers, filaments or fabric web are conducted in a V-shape through the bath.

13 Claims, 4 Drawing Sheets

Figure 1:
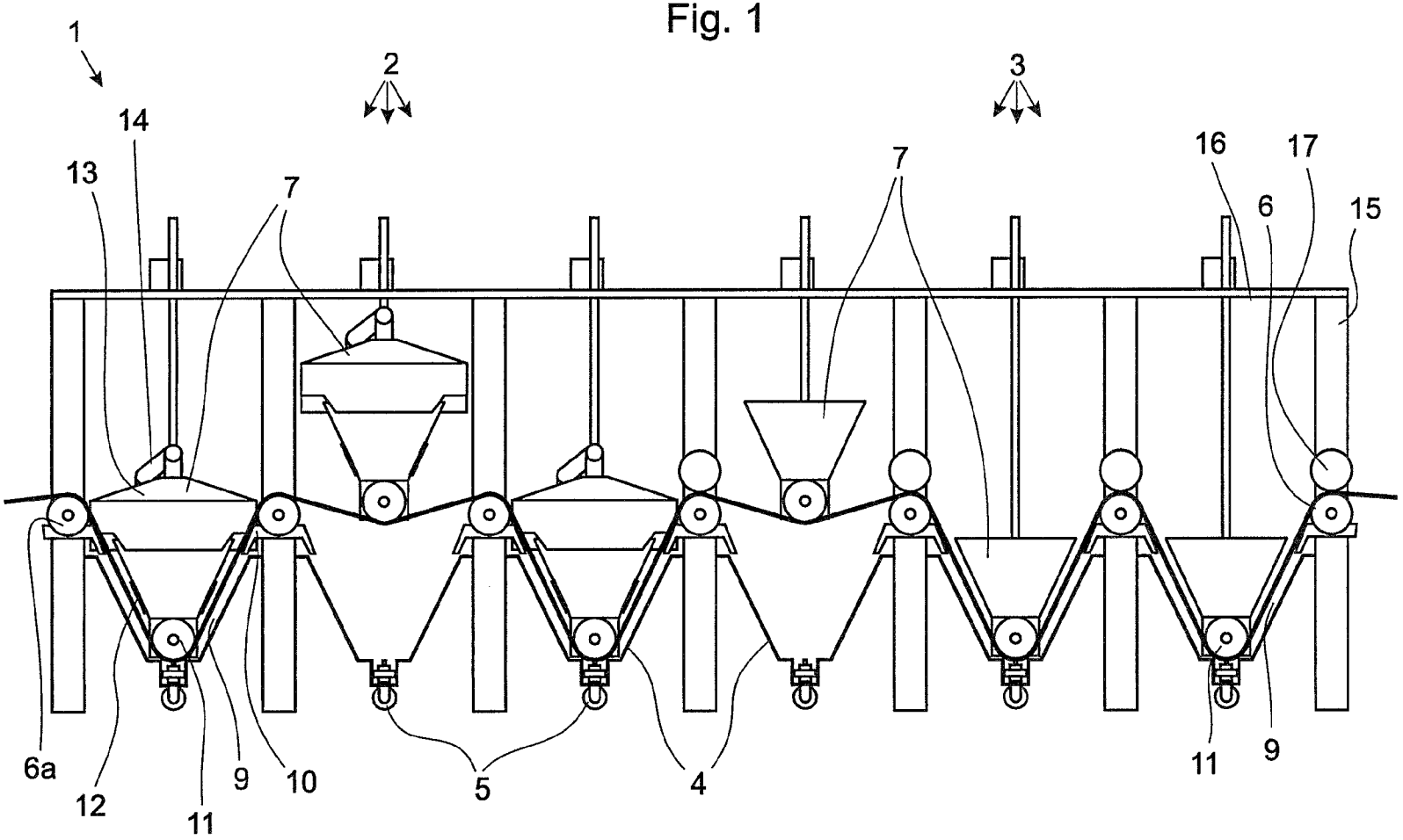

(51) Int. Cl.

| | |
|---|---|
| ***D06B 3/10*** | (2006.01) |
| ***D06B 19/00*** | (2006.01) |
| ***D06B 3/12*** | (2006.01) |
| ***D06C 7/04*** | (2006.01) |

(56) References Cited

U.S. PATENT DOCUMENTS

| | | | | |
|---|---|---|---|---|
| 2,481,992 | A | 2/1945 | Fisher | |
| 3,128,206 | A * | 4/1964 | Dungler ..... | D06B 3/10<br>118/419 |
| 3,791,132 | A | 2/1974 | Schutz et al. | |

FOREIGN PATENT DOCUMENTS

| | | | |
|---|---|---|---|
| DE | 30615909 | T2 | 5/2008 |
| EP | 0383253 | A1 | 8/1990 |
| EP | 1348794 | A2 | 10/2003 |
| FR | 984024 | A | 7/1951 |
| FR | 2064150 | A1 | 7/1971 |
| GB | 2425543 | A | 11/2006 |
| JP | S61296164 | A | 12/1986 |

* cited by examiner

DEVICE AND METHOD FOR THE TREATMENT, IN PARTICULAR ELECTROLYSIS OR CLEANING, OF ENDLESS FIBERS, THREADS OR WEBS OF FABRIC

The invention relates to a bath and to a method of treating endless fibres, filaments or fabric webs, especially for electrolysis or for cleaning, comprising a bath container, which is at least partly filled with a processing fluid, and means for introducing the endless fibres, filaments or fabric webs.

In known baths for the electrolysis or the subsequent cleaning of endless fibres, the fibres are introduced into a bath by means of guide rollers, subjected to electrochemical or only chemical treatment and guided out of the bath by means of guide rollers. In dependence upon the duration of treatment and the throughput rate of the fibres, the baths can have a length of up to more than 50 meters, which enormously increases the cost of producing the baths and the volume of fluid to be used. Furthermore, complete and uniform treatment of the fibre strands across the width of the bath is not always ensured, because non-uniform flows can also arise inside the bath. Given the size of the resulting baths, it is extremely difficult to implement a covering for the baths that is easy to open and a reliable means for extracting vapours.

In U.S. Pat. No. 2,481,992 an immersion roller is mounted in and on the bath container. Accordingly, complex bearing and sealing problems arise in view of the aggressive and hot processing fluid. Replacing or servicing the immersion roller is possible only with a bath container empty. Starting-up the plant and threading in the fabric web is hazardous for the operating personnel.

EP 1 348 794/DE 60 315 909 shows a bath container through which two mesh belts run in a V-shape and in so doing carry with them the textiles being treated. It is therefore possible to realise neither a reduction in the processing fluid nor an adjustment of the flow. Furthermore, the guide rollers can be serviced or replaced only after a bath container has been emptied.

DD 70060 shows a processing container in which an approximately V-shaped container wall (19) is arranged. On the inlet side the fabric web is sprayed by means of injection nozzles (21, 22) and on the outlet side the processing fluid overflows into the container wall (19). The transport of the fabric web is effected by means of two chains arranged in the bath. Rapid throughput with intensive treatment of the fabric web cannot be realised with this plant.

The problem of the invention is to provide a bath and a method of treating endless fibres, filaments or fabric webs, especially for electrolysis or for cleaning, that has a reduced overall length, wherein the flow conditions are adjustable and wherein the introduction of the endless fibres, filaments or fabric webs is readily possible.

In accordance with the technical teaching of the invention, the bath, especially for electrolysis or for cleaning, comprises a bath container, which is at least partly filled with a processing fluid, and means for introducing the endless fibres, filaments or fabric webs, the means being arranged in such a way that the endless fibres, filaments or fabric web are conducted in a V-shape through the bath. Due to the fact that the endless fibres are conducted in a V-shape through the bath, the external dimensions of the baths can be significantly reduced, although the dwell time of the fibres being treated remains the same or can be significantly increased. Reducing the length of the bath gives rise to many further advantages, such as, for example, a structurally simpler bath covering, because a much smaller area has to be covered.

As means for introducing the endless fibres, filaments or fabric webs, two guide rollers and an immersion roller are provided. These are likewise arranged in a V-shape, the guide rollers each being arranged in the region of an edge of the bath container, and the immersion roller being introducible centrally in the bath container. It is accordingly possible to operate the bath with one fewer roller than in the case of the prior art, which, given the lengths and diameters of the rollers, represents a considerable cost advantage.

Due to the fact that the bath container is constructed in a V-shape, it is possible to achieve a first reduction in the volume of processing fluid required. With the reduction in the volume of the processing fluid, such as, for example, electrolysis fluid or washing fluid, it is also possible for the associated components, such as pumps, pipelines, etc., to have smaller dimensions, which renders the plant more compact and more economical. Furthermore, a smaller amount of processing fluid also represents fewer problems as regards disposal or treatment of the processing fluid, which reduces the operating costs for the plant.

According to the invention, the immersion roller is arranged on a displacement body, so that the fixing means for the immersion roller is simple and accordingly need not be arranged on or in the bath container. At the same time, the displacement body reduces the amount of processing fluid required, so that the above-mentioned advantages once again come into particular effect.

A further advantage is achieved as a result of the fact that the displacement body is arranged so as to be vertically movable and is able to move into and out of the bath container. When the baths, for example an electrolysis bath, are started up, the displacement body with the immersion roller can be moved entirely out of the bath. The endless fibres, filaments or fabric web can be introduced into the bath without the operator coming into contact with the processing fluid. The endless fibres can be introduced between the guide rollers and immersion rollers in almost a straight line. It is only once the displacement body has been lowered that the endless fibres follow the V-shaped path through the bath container.

In an advantageous embodiment the shape of the displacement body is complementary to that of the bath container so that when the displacement body is in the lowered state there is formed between the displacement body and the bath container a channel filled with processing fluid, through which the endless fibres, filaments or fabric web are guided. The channel serves for further reducing the volume of processing fluid required. At the same time, by way of the channel it is possible to establish advantageous flow conditions for the treatment of the endless fibres, which significantly reduce the dwell time and thus contribute to a further reduction in bath lengths. For example, the processing fluid can be set to flow in cocurrent or counter-current mode in the channel, by means of which it is possible to influence the treatment of the endless fibres.

Furthermore, by connecting an overflow to the channel it is possible to generate a continuous flow between a plurality of baths arranged one next to the other. The processing fluid flows continuously through the channels of all the baths, without it being necessary to stagger the heights of the baths.

The baths are advantageously constructed in such a way that a plurality of baths can be arranged module-like one next to the other. For that purpose, the frameworks of the baths can be arranged in such a way that between two free-standing baths a further bath is suspended, with only the horizontal parts of the framework and two vertical supports being required. By the arrangement of the guide rollers above the bath containers, two bath containers can share one guide roller.

In an advantageous embodiment, the displacement body has a hood for covering the bath container. The integration of the hood with the displacement body provides a reliable covering for the bath container. Contrary to the prior art, it is unnecessary first to open the hood and then move the displacement body with the immersion roller. A further advantage is the economical arrangement of the hood, which no longer has be attached to its own articulated joints and opened.

Due to the fact that the hood has an exhaust means, undesired vapours can be extracted.

Simultaneous vertical movement of the displacement body with the hood and the exhaust means provides operational reliability. When the displacement body is raised in order, for example, to introduce a new endless fibre, the bath container is opened at the same time. Unlike the prior art, according to the invention this can take place automatically, with malfunction being eliminated. The baths are accordingly always closed during operation, so that, for example in the case of an electrolysis bath, the bath can never be operated with the hood open.

In an advantageous embodiment, the bath is in the form of a washing bath, it being possible to use, for example, water or demineralised water as the processing fluid.

For implementation in the form of an electrolysis bath, the bath can be fully electrically insulated.

The cathodes can in that case be arranged on the displacement body, so that they can be replaced when the displacement body has been withdrawn. In this arrangement the cathodes are active only when they are immersed in the processing fluid and, by way of the endless fibres, an electrical connection is made with the guide roller, which is in the form of an anode roller.

The method according to the invention for treating endless fibres, filaments or fabric webs, especially for electrolysis or for cleaning, wherein the endless fibres, filaments or fabric webs are guided into a bath container containing a processing fluid, is characterised in that the endless fibres, filaments or fabric web are conducted in a V-shape through the bath. Accordingly, the dwell time of the endless fibres in the bath can be increased, although the external dimensions of the baths are significantly reduced. Reducing the length of the bath gives rise to many further advantages, such as, for example, a structurally simpler bath covering, because a much smaller area has to be covered.

A further advantageous improvement is achieved by conducting the endless fibres, filaments or fabric webs through a channel in the bath container which is formed from a V-shaped bath container and a displacement body complementary thereto. The displacement body serves for further reducing the volume of processing fluid required. At the same time, by way of the channel so produced, it is possible to establish advantageous flow conditions for the treatment of the endless fibres, which significantly reduce the dwell time and thus contribute to a further reduction in bath lengths. For example, the processing fluid can be set to flow in cocurrent or counter-current mode in the channel, by means of which it is possible to influence the treatment of the endless fibres.

It is possible to use the plant for carbonisation, in which endless fibres, filaments or fabric webs made of plastics are oxidised, carbonised and subjected to a surface-treatment in a combined electrolysis and washing bath, the endless fibres, filaments or fabric webs being conducted in a V-shape through the electrolysis and washing bath. The carbonisation plants as a whole can reach lengths of far more than 100 m and are installed in a dedicated room. Any reduction in the length of individual components significantly reduces the overall investment, so that shorter electrolysis and washing baths with the same dwell time not only enable the baths to be produced more economically but have a significant effect on the plant as a whole.

A carbonisation plant with electrolysis and washing baths having a V-shaped bath container with a displacement body complementary thereto, which are able to form a channel for treating the endless fibres, filaments or fabric webs, has the advantage that the flow conditions in the channel can be established in such a way that the number of baths and the length thereof can be reduced. The length of the plant as a whole is accordingly reduced and throughput times for the entire carbonisation process become shorter, because the upstream reservoirs, which are intended to compensate for the different operating times of the individual plant components, can be made smaller.

Figure 2:
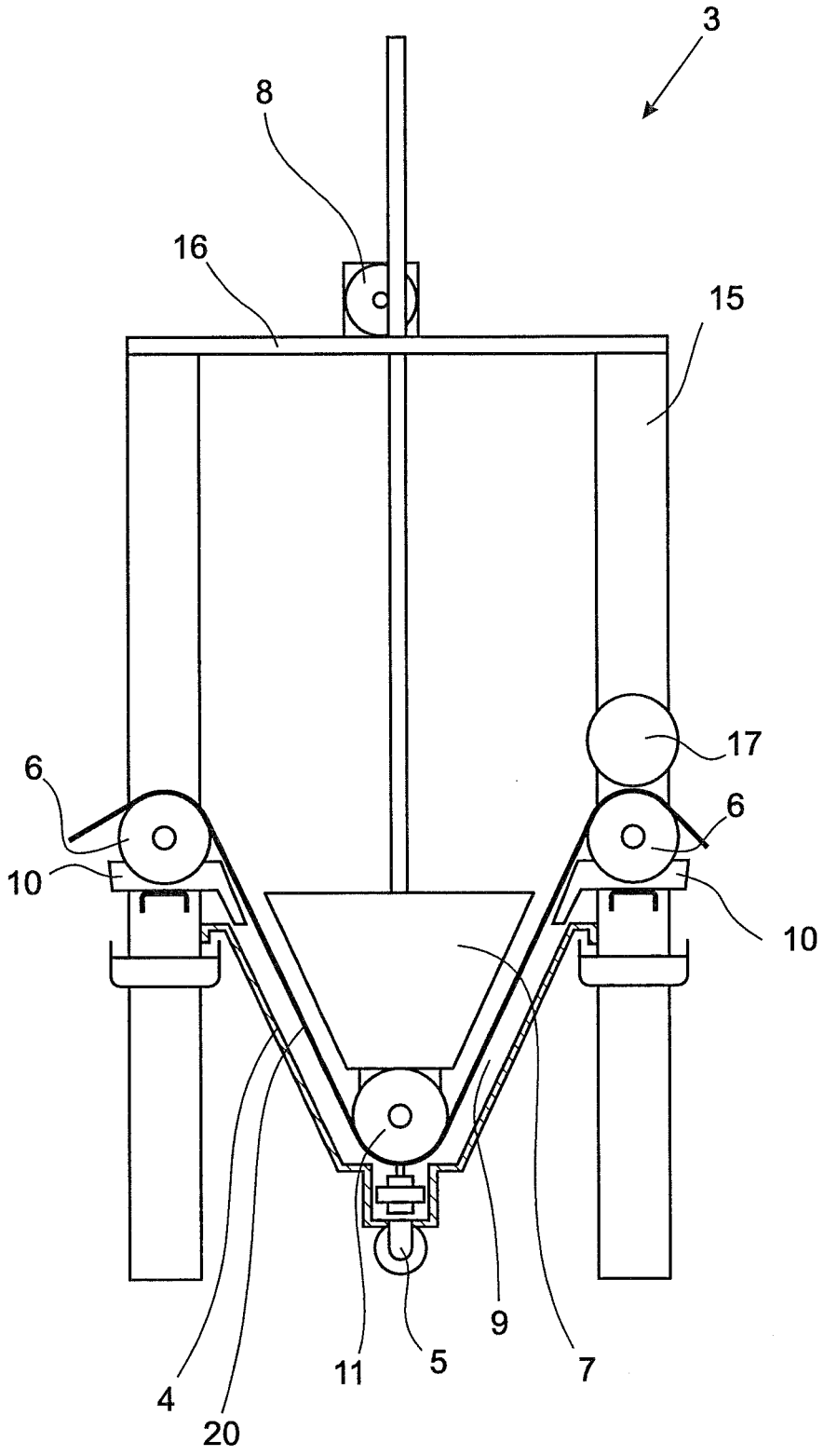
Figure 3:
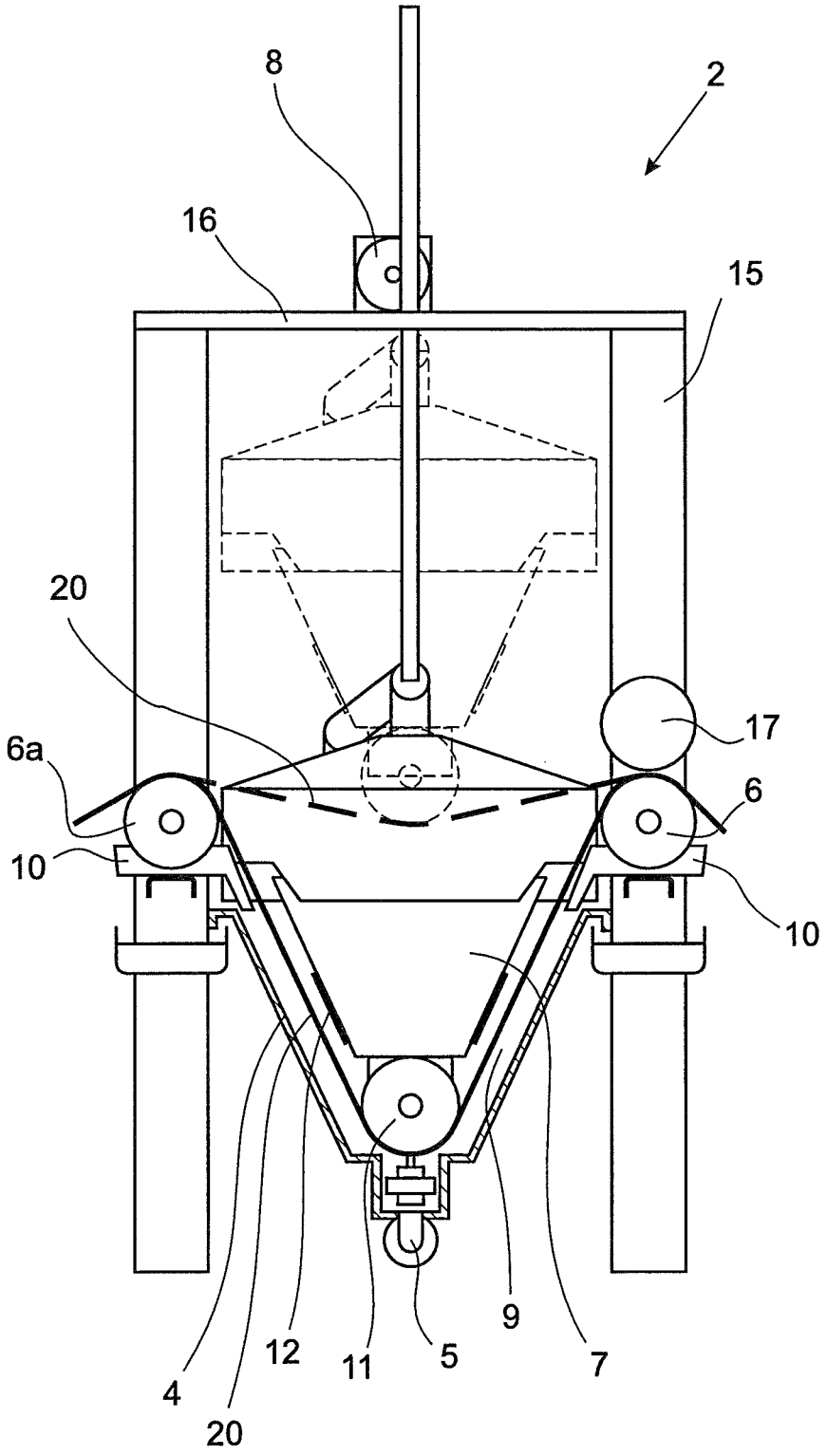
Figure 3A:
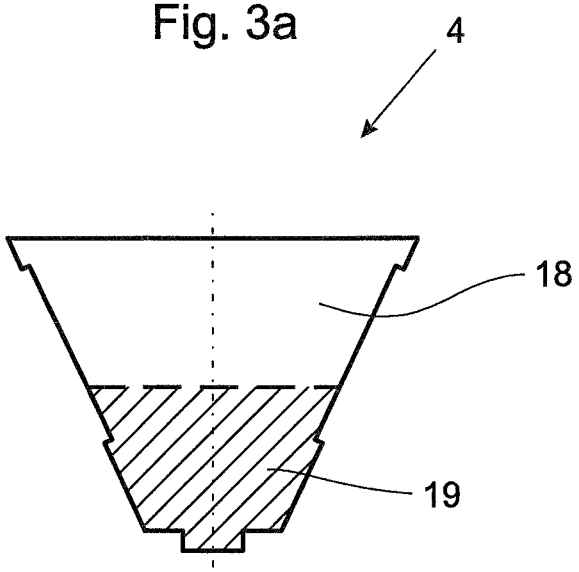
Figure 3B:
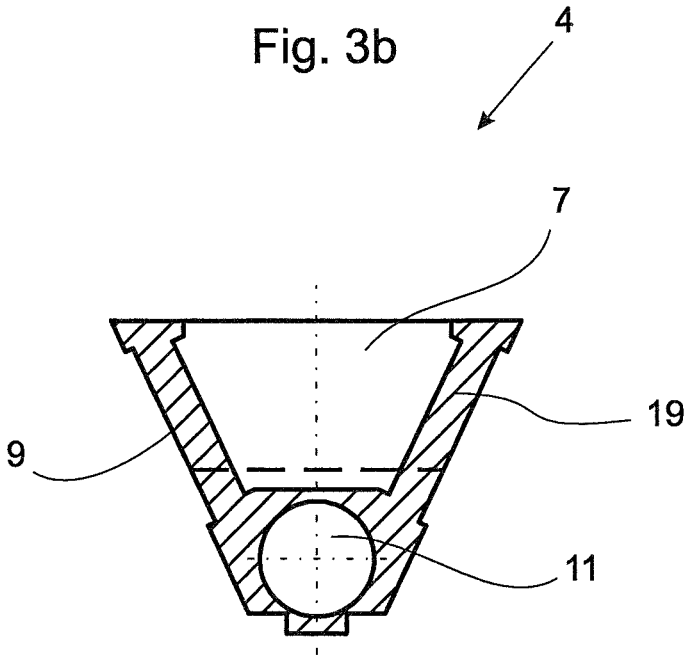

The invention is described in greater detail below with reference to a possible exemplary embodiment shown diagrammatically in the drawings, wherein:

FIG. 1: is a side view of a plurality of electrolysis baths with subsequent washing baths;

FIG. 2: is an enlarged view of a washing bath;

FIG. 3: is an enlarged view of an electrolysis bath;

FIG. 3*a* shows the free cross-section of an electrolysis or washing bath without a displacement body;

FIG. 3*b*: shows the free cross-section of an electrolysis or washing bath with a displacement body.

FIG. 1 shows a plant 1 for treating endless filaments, fibres or fabric webs which consists inter alia of a combined electrolysis and washing bath. The combined electrolysis and washing bath can be part of a complete system in which, for example, endless fibres made of plastics are carbonised. In that case, for example, a reservoir and/or a drawing device is arranged upstream of the combined electrolysis and washing bath and a winding device is arranged downstream thereof.

In this exemplary embodiment the combined electrolysis and washing bath comprises three electrolysis baths 2 which are arranged one after the other and which are followed by three washing baths 3 arranged one after the other. The baths 2, 3 can be arranged module-like one after the other, support being provided by a part of a vertical framework 15 on its own or in conjunction with the framework of the next bath 2, 3. It will be seen that, in dependence upon the materials being processed, any desired different number of electrolysis and/or washing baths 2, 3 is also possible or can be combined with one another.

Each bath 2, 3 has a bath container 4 which in this exemplary embodiment is in the shape of an inverted trapezium or triangle, that is to say has essentially a V-shape, with the inflow control means 5 for the fluid of the bath 2, 3 being arranged in the lower point of the trapezium or triangle. Above each bath 2, 3 there are arranged, somewhat to the side, two guide rollers 6 with which the endless fibres are guided into the bath 2, 3. In this exemplary embodiment the guide rollers 6 are arranged in the upper region of the trapezium or triangle in the region of the edges. As a result of the module-like construction and the trapezoidal or triangular shape, it is sufficient for two baths 2, 3 arranged one next to the other to share one guide roller 6. In the case of baths 2, 3 of a more rectangular shape, as in the prior art, two guide rollers 6 would be necessary here.

Above each bath container 4 there is arranged a displacement body 7 which can be fully withdrawn from the bath container 4. This can be effected using a drive means 8, such as a spindle or an automatic drive means. The displacement body 7 likewise has a trapezoidal or triangular shape and can be immersed completely in the bath container 4. As a result, a very narrow channel 9 between the displacement body 7 and the bath container 4 is formed which needs to hold significantly less fluid than a bath 2, 3 without a displacement body 7. A further crucial advantage is the specific influence of the flow conditions in this narrow channel 9, so that, for example, the fibres can be moved through the fluid in cocurrent or counter-current mode. In order to generate a flow through a plurality of baths (2 or 3), between the electrolysis baths 2 and between the washing baths 3 there is in each case an overflow 10 with which, on the one hand, a continuous flow through a plurality of baths (2 or 3) can be generated, but at the same time the baths 2, 3 can be operated with a small amount of fluid, because at the first or last bath there is arranged a circulation control means in the form of valves and pipelines. Each trapezoidal or triangular displacement body 7 has, in the region of its lower point, an immersion roller 11 which is immersed in the bath fluid and guides the fibres inside the bath 2, 3. The immersion roller 11 can be integrated so as to be rotatable inside the displacement body 7 or can be rotatably mounted spaced apart therefrom. Here too—unlike a rectangular displacement body 7—only one immersion roller 11 per bath container 4 needs to be arranged on the displacement body 7. When the baths 2, 3 are started up, all the displacement bodies 7 are withdrawn, so that the baths 2, 3 are freely accessible. The displacement bodies 7 can be raised to such an extent that the fibres can be drawn in a continuous line, without diversions, across the baths 2, 3, for example from a draw frame to a furnace between which the baths 2, 3 are arranged. Threading into the baths 2, 3 takes place automatically, because when the displacement bodies 7 are lowered the fibres are immersed in the baths 2, 3 and are guided around all the guide rollers 6 and the immersion rollers 11. As a result of the trapezoidal or triangular shape of the baths 2, 3 with the displacement bodies 7, the resulting channel 9 for treating the fibres is several times longer than the external length of the baths arranged one after the other.

FIG. 2 shows an enlarged view of an individual washing bath 3. Inside vertical frameworks 15, which are supported by horizontal frameworks 16, there is arranged a bath container 4 in which a displacement body 7, movable in the vertical direction, can be immersed. In this exemplary embodiment both the bath container 4 and the displacement body 7 have a V-like shape resembling an inverted trapezium. In the lower region, the bath container 4 and the displacement body 7 are flattened so that, once the displacement body 7 is immersed in the bath container 4, preferably a channel 9 of approximately constant cross-section is formed. Below the bath container 4 there is arranged the inflow control means 5 with which washing fluid can be fed into the bath container 4. Above the bath container 4 there is arranged on each side a guide roller 6 on which additional pressing rollers 17 can be arranged. The fibres 20 in that case run between the guide rollers 6 and the pressing rollers 17 which provide for additional stripping of cleaning fluid from the washing bath 3. This stripped cleaning fluid is returned to the washing bath 3 again. In the region of each guide roller 6 there is arranged an overflow 10 with which the washing fluid from the channel 9 is fed into or from the adjacent washing bath, so that it is possible to generate a continuous flow through a plurality of washing baths 3 arranged in a row. The washing baths 3 are usually implemented without electrical insulation. Water or demineralised water can be used as circulating medium, it being possible to employ increased pumping capacity to increase the rate of flow in order to intensify the washing effect. The displacement body 7 has at its lower end an immersion roller 11 which is arranged so as to be rotatable on the displacement body 7 and is simultaneously lowered therewith into the bath container 4. For the vertical movement of the displacement body 7 there is used a drive means 8 which can be operated mechanically or automatically. When the displacement body 7 with the immersion roller 11 is fully withdrawn from the bath container 4 by means of the drive means 8, free access is gained for introduction of the fibres 20, without the operating personnel coming into contact with the washing fluid. The fibres then run horizontally above the bath container 4 and lie only optionally on the guide rollers 6 and the immersion roller 11. When the displacement body 7 is moved into the bath container 4, the fibres 20 are then drawn into the bath container 4 by the immersion roller 11, so that the fibres 20 follow a triangular or V-shaped path through the washing baths 3. The substantial diversion of the fibres, together with an inflow device which is specially constructed between the immersion roller 11 and the inflow control means 5 and has an integrated flow rectifier, has the result that the individual fibre bundles are uniformly acted upon and penetrated by the fluid.

It will be seen that the washing baths 3 can be mounted module-like in a row, the washing baths (in this case not shown) also making use of the guide rollers 6 of the washing bath 3 shown in FIG. 2. Although not shown, covering the washing baths 3 with a hood 13 is likewise a sensible option.

FIG. 3 is an enlarged view of an electrolysis bath 2. Without repeating all the details of the virtually identical construction from FIG. 2, here reference is made essentially to the following differences:

For the electrolysis process, the guide rollers 6 are implemented in the form of anode rollers 6*a*, whereas the cathodes 12, in the form of electric plates, are arranged on the side walls of the displacement body 7 so that when the displacement bodies 7 are lowered into the baths 2 they come into contact with the fluid, that is to say they are arranged in the channel 9 that is formed. Furthermore, the displacement bodies 7 have in the upper region an integrated hood 13 which, on the one hand, seals the electrolysis bath 2 and, on the other hand, is equipped with an exhaust means 14, so that vapours, such as, for example, electrolysis gases, hydrogen, ammonia or other process vapours, are extracted from the production area and at the same time the possibility of elevated pressure is avoided. Since the hood 13, together with the exhaust means 14, is connected to the displacement body 7, as the displacement bodies 7 travel up and down the electrolysis baths 2 are simultaneously fully opened or closed, without any need for the hood 13 to be operated separately, as known from the prior art. FIG. 3 shows in dotted lines the upper and lower positions of the displacement body 7. In the upper position, the fibres 20 are able to pass freely between the anode rollers 6*a* and the immersion roller 11, without the operators coming into contact with the electrolysis fluid. The fibres can be drawn through freely between the rollers 6*a*, 11 or alternatively, as shown here, they rest very lightly on the rollers 6*a*, 11. When the displacement body 7 is lowered into the electrolysis bath 2 by means of the drive means 8, the fibres 20 are pushed into the electrolysis fluid by the immersion roller 11. A channel 9, through which the fibres 20 pass, is formed between the electrolysis bath 2 and the displacement body 7. At the same time as the lowering of the displacement body 7, the electrolysis bath 2 is closed by the hood 13.

In order to ensure a reliable electrolysis process and to avoid the possibility of electrical short-circuiting, the electrolysis baths 2 are fully electrically insulated. For example, the bath container 4 and the adjoining pipework can be made at least partly of plastics. An electrolyte is used as the circulating medium.

FIG. 3*a* shows in simplified form how a washing or electrolysis fluid is distributed in the bath container 4. The cross-section 18 of the bath container 4 can be, for example, 0.5 $m^2$. The volume of the bath container of course depends upon the working width of the entire production plant which can be between 0.5 and 5 m. Without the displacement body 7, as shown according to FIG. 3*a*, the amount of washing or electrolysis fluid required would accordingly be that which, in side view, covers the entire 0.5 $m^2$ area of the bath container 4. The cross-section fluid 19 indicates the amount of processing fluid required when a displacement body 7 is used. This is shown in FIG. 3*b*. As a result of the displacement body 7 with the attached immersion roller 11, the amount of fluid required is significantly less than in accordance with the prior art, so that a cross-section fluid 19 of only 0.2 $m^2$, that is to say only 40% of the previous volume, is required.

Accordingly, in the case of an electrolysis and washing bath 2, 3 according to the invention, 60% less processing fluid is required, which makes the process very economical and effective, because at the same time the tank (not shown) and the circulating systems for the processing fluid can also be made significantly smaller.

The V-shape of the baths 2, 3 and of the displacement bodies 7 results in the formation of a channel 9 which is arranged in a V-shape and which has a substantially longer flow length than is apparent from the external dimensions of the combined electrolysis and washing bath. For a given dwell time for the endless fibres, filaments or fabric web, the overall length for the electrolysis and washing baths can be drastically reduced. Furthermore, a defined channel 9 is formed in which the flow conditions are adjustable.

The vertical movability of the displacement bodies 7 allows unimpeded introduction of fibres 20 into the plant, without the operators coming into contact with the processing fluid.

The baths shown herein can be used not only as electrolysis and washing baths but also, for example, as sizing baths. Their implementation then corresponds to that of the washing bath 3 shown herein, the choice of materials and the pump circuit being adapted in accordance with the fluid used.

REFERENCE NUMERALS

1 plant
2 electrolysis bath
3 washing bath
4 bath container
5 inflow control means
6 guide rollers
6*a* anode rollers
7 displacement body
8 drive means
9 channel
10 overflow
11 immersion roller
12 cathode
13 hood
14 exhaust means
15 framework
16 framework
17 pressing rollers
18 cross-section bath container
19 cross-section fluid
20 fibres

The invention claimed is:

1. A bath for treating endless fibres, filaments or fabric webs, comprising;

a V-shaped bath container at least partly filled with a processing fluid; and means for introducing the endless fibres, filaments or fabric webs so that the endless fibres, filaments or fabric web are conducted in a V-shape through the bath, the means for introducing the endless fibres, filaments or fabric webs comprising two guide rollers, an immersion roller and a V-shaped displacement body on which the immersion roller is arranged, wherein the V-shaped displacement body with the immersion roller is arranged to have a lowered position completely immersed in the V-shaped bath container and to be fully withdrawn from the bath container, wherein the shape of the V-shaped displacement body is complementary to the V-shaped bath container so that when the V-shaped displacement body is in the lowered position in the V-shaped bath container a V-shaped channel filled with processing fluid is defined between the V-shaped displacement body and the V-shaped bath container, wherein the V-shaped channel extends through the whole bath container and the endless fibres, filaments or fabric web are guided through the V-shaped channel.

2. The bath according to claim 1, wherein the displacement body is arranged to be vertically movable into and out of the bath container.

3. The bath according to claim 1, wherein the displacement body includes a hood for covering the bath container.

4. The bath according to claim 3, wherein the hood includes an exhaust adapted to exhaust undesired vapours.

5. The bath according to claim 4, wherein the displacement body, with the hood and the exhaust, is vertically movable.

6. The bath according to claim 1, wherein the bath is an electrolysis bath.

7. The bath according to claim 6, further including cathodes arranged on the displacement body.

8. The bath according to claim 6, wherein the guide rollers comprise anode rollers.

9. The bath according to claim 1, wherein the two guide rollers are mounted above the bath container.

10. A plant comprising a plurality of baths each according to claim 1 and arranged as modules, one next to the other.

11. The plant according to claim 10, wherein each displacement body has a shape that is complementary to that of the bath container so that when the displacement body is in a lowered state in which the displacement body is immersed completely in the bath container, a channel filled with processing fluid is defined between the displacement body and the bath container through which the endless fibres, filaments or fabric web are guided, and the channel is connected to an overflow to generate a continuous flow of processing fluid between the plurality of baths.

12. A method of treating endless fibres, filaments or fabric webs, for electrolysis or for cleaning, comprising:

guiding the endless fibres, filaments or fabric webs into a V-shaped bath container containing a processing fluid, wherein the guiding includes guiding the endless fibres, filaments or fabric webs by an immersion roller inside the bath container, and including arranging the immersion roller on a V-shaped displacement body arranged to have a lowered position completely immersed in the V-shaped bath container and having a shape complementary to the V-shaped bath container, wherein the V-shaped displacement roller is adapted to be fully withdrawn with the immersion roller from the bath container, and further including conducting the endless fibres, filaments or fabric webs through a V-shaped channel in the bath container defined between the V-shaped bath container and the V-shaped displacement body in the lowered position, wherein the V-shaped channel extends through the whole bath container.

13. The method according to claim 12, further including arranging the displacement body to be vertically movable for introduction of the endless fibres, filaments or fabric webs into the bath.

* * * * *